US010010194B2

(12) United States Patent
He et al.

(10) Patent No.: US 10,010,194 B2
(45) Date of Patent: Jul. 3, 2018

(54) GAME ENCLOSURE

(71) Applicant: Goodbaby Child Products Co., Ltd., Kunshan, Jiangsu (CN)

(72) Inventors: Xinjun He, Jiangsu (CN); Fusheng Ma, Jiangsu (CN)

(73) Assignee: GOODBABY CHILD PRODUCTS CO., LTD. (CN)

( * ) Notice: Subject to any disclaimer, the term of this patent is extended or adjusted under 35 U.S.C. 154(b) by 0 days.

(21) Appl. No.: 15/527,277

(22) PCT Filed: Dec. 29, 2014

(86) PCT No.: PCT/CN2014/095420

§ 371 (c)(1),
(2) Date: May 16, 2017

(87) PCT Pub. No.: WO2016/078183

PCT Pub. Date: May 26, 2016

(65) Prior Publication Data

US 2018/0014662 A1 Jan. 18, 2018

(30) Foreign Application Priority Data

Nov. 17, 2014 (CN) ..... 2014 1 0654054

(51) Int. Cl.
*A47D 13/06* (2006.01)

(52) U.S. Cl.
CPC ..... *A47D 13/063* (2013.01)

(58) Field of Classification Search
CPC .... A47D 13/06; A47D 13/061; A47D 13/063; A47D 13/066
See application file for complete search history.

(56) References Cited

U.S. PATENT DOCUMENTS 5,349,709 A * 9/1994 Cheng ..... A47D 7/03 5/93.1
2006/0185082 A1* 8/2006 Casati Troutman . A47D 13/063 5/99.1

(Continued)

FOREIGN PATENT DOCUMENTS

CN 202445622 U 9/2012
CN 202751091 U 2/2013

(Continued)

OTHER PUBLICATIONS

International Written Opinion for Application No. PCT/CN2014/095420, dated May 27, 2015 in 8 pages.

(Continued)

*Primary Examiner* — Eric J Kurilla
(74) *Attorney, Agent, or Firm* — Knobbe Martens Olson & Bear LLP

(57) ABSTRACT

Disclosed is a game enclosure comprising an enclosure frame, a child support assembly and a cloth cover. The enclosure frame comprises an upper frame, a bottom support rack and a plurality of upright rods arranged between the upper frame and the bottom support rack. The child support assembly comprises a cloth bag frame and a cloth bag. The cloth bag frame comprises two cross braces respectively placed on the front side and the rear side, two connecting rod assemblies respectively placed on the left side and the right side, and locking mechanisms. Each connecting rod assembly comprises two connecting rods, the inner ends of the two connecting rods are connected in a relatively rotatable manner, and the outer ends of the two connecting rods are respectively connected to the two cross braces in a rotatable manner.

10 Claims, 4 Drawing Sheets

(56) References Cited

U.S. PATENT DOCUMENTS

| | | | | |
|---|---|---|---|---|
| 2007/0214576 | A1* | 9/2007 | Espenshade | A47D 13/063 5/723 |
| 2013/0086750 | A1* | 4/2013 | Cheng | A47D 5/006 5/655 |
| 2013/0160205 | A1* | 6/2013 | Dowd | A47D 13/063 5/99.1 |
| 2016/0242566 | A1* | 8/2016 | Tadipatri | A47D 13/066 |
| 2016/0338506 | A1* | 11/2016 | Yang | A47D 13/063 |

FOREIGN PATENT DOCUMENTS

| | | | |
|---|---|---|---|
| CN | 203524283 | U | 4/2014 |
| WO | WO 2012/115677 | A1 | 8/2012 |
| WO | WO 2016/078183 | A1 | 5/2016 |

OTHER PUBLICATIONS

International Search Report for Application No. PCT/CN2014/095420, dated May 27, 2015.

* cited by examiner

GAME ENCLOSURE

TECHNICAL FIELD OF THE INVENTION

The present disclosure relates to a game enclosure.

BACKGROUND OF THE INVENTION

The game enclosure includes an enclosure frame, a cloth cover provided on the enclosure frame, and a child support assembly for supporting the child provided on the enclosure frame or the cloth cover. In the prior art, the child support assembly typically includes a child support frame and a fiberboard disposed on the child support frame. When folding the game enclosure, due to that the fiberboard is a rigid part, resulting in that the child support assembly and the game enclosure are difficult to be folded, and the folding process is complicated, folded volume is still large, and the folding is not flexible.

SUMMARY OF THE INVENTION

Aiming at the above problems, the present disclosure is intended to provide a game enclosure, which is convenient for folding and has a small folded volume and good gas permeability.

To solve the above technical problems, the present disclosure employs the following technical solutions:

a game enclosure, comprises an enclosure frame, a child support assembly and a cloth cover arranged over the enclosure frame, and the enclosure frame comprises an upper frame, a bottom support rack located below the upper frame and a plurality of upright rods arranged between the upper frame and the bottom support rack; the child support assembly has a unfolded state and a folded state, when the child support assembly is in the unfolded state, the child support assembly is horizontally and detachably arranged on the upright rods or the bottom support rack or the cloth cover, and when the child support assembly is in the folded state, the child support assembly is detached from the upright rods or the bottom support rack or the cloth cover; the child support assembly comprises a cloth bag frame and a cloth bag connected on the cloth bag frame to support a child, the cloth bag frame comprises two cross braces respectively arranged at the front side and the rear side, and two connecting rod assemblies connected between the two cross braces and respectively placed on the left side and the right side, each connecting rod assembly comprises two connecting rods, inner ends of the two connecting rods of each connecting rod assembly are connected in a relatively rotatable manner, and outer ends of the two connecting rods are respectively connected to the two cross braces in a rotatable manner; when the child support assembly is in the folded state, the outer ends of the two connecting rods on the same side are drawn close to each other, and the inner ends of the respective connecting rods are drawn close to the cross braces.

Preferably, each connecting rod assembly comprises a first connector, the inner end of one connecting rod in each connecting rod assembly is rotatably connected to the first connector via a first pivot, the inner end of the other connecting rod is rotatably connected to the first connector via a second pivot, and when the child support assembly is in the unfolded state, the first pivot and the second pivot are parallel to each other and extend along a horizontal direction.

Preferably, the inner ends of the two connecting rods in each connecting rod assembly are connected in a relatively rotatable manner via a third pivot, and when the child support assembly is in the unfolded state, the third pivot extends along a horizontal direction.

Preferably, the child support assembly comprises a locking mechanism for locking the child support assembly in the unfolded state or in the folded state.

More preferably, the locking mechanism comprises a plurality of locking elements having the same number of the connecting rods, each connecting rod assembly comprises a first connector, the inner end of one connecting rod in each connecting rod assembly is rotatably connected to the first connector via a first pivot, the inner end of the other connecting to rod is rotatably connected to the first connector via a second pivot, and when the child support assembly is in the unfolded state, the first pivot and the second pivot are parallel to each other and extend along a horizontal direction; the locking elements are detachably connected to the connecting rods and the first connectors, when the locking elements are connected to the connecting rods and the first connectors, the locking mechanism locks the child support assembly in the unfolded state, and when the locking elements are detached from the connecting rods and the first connectors, the child support assembly is in a foldable unlocked state.

More preferably, the locking mechanism comprises locking elements detachably connected to the two connecting rods of each connecting rod assembly, the inner ends of the two connecting rods in each connecting rod assembly are connected in a relatively rotatable manner via a third pivot, and when the child support assembly is in the unfolded state, the third pivot extends along a horizontal direction; when the locking elements are connected to the two connecting rods of each connecting rod assembly, the locking mechanism locks the child support assembly in the unfolded state, and when the locking elements are detached from the two connecting rods of each connecting rod assembly, the child support assembly is in a foldable unlocked state.

Preferably, the cloth bag frame further comprise a plurality of second connectors, one of the cross brace and the connecting rod is fixedly connected to the second connector and the other one is rotatably connected to the second connector via a fourth pivot, and the fourth pivot extends along a upright direction.

Preferably, when the child support assembly is in the unfolded state, each of the connecting rods is inclined from the outer end to the inner end thereof so as to be gradually remote from another connecting rod assembly, and each of the connecting rod assemblies is slightly deformed to tighten the cloth bag over the cloth bag frame.

Preferably, the cloth bag is made of gauze providing malleability.

Preferably, the two connecting rods of each connecting rod assembly pivot about a pivot extending along a horizontal direction, each of the connecting rods and the cross braces pivot about a pivot extending along a upright direction, and the child support assembly achieves the folded state after twice folding, in the first folding, the inner ends of the two connecting rods of each connecting rod assembly move upwards or downwards so as to draw the outer ends of the two connecting rods close to each other, and in the second folding, the inner end of each connecting rod is drawn close to the cross brace.

The present disclosure has the following advantages over the prior art by employing the above structure: the cloth bag frame of the child support assembly achieves the folded state after twice folding, and the folding of the cloth bag frame is achieved by operating the connecting rods, the game enclosure of the present disclosure and the child support assembly thereof is easy to be folded and have small folded volumes; besides, the cloth bag can be folded along with the frame due to that the cloth bag possesses elasticity.

Wherein, 100—child support assembly; 101—cloth bag frame; 1—cross brace; 2—connecting rod assembly; 21—connecting rod; 22—first connector; 23*a*—first pivot; 23*b*—second pivot; 23*c*—third pivot; 24—locking element; 3—second connector; 31—fourth pivot; 102—cloth bag;

200—enclosure frame; 201—upper frame; 202—upright rod; 203—bottom support rack;

300—cloth cover.

DETAILED DESCRIPTION OF EXEMPLARY EMBODIMENTS

In the following, the preferable embodiments of the present disclosure are explained in detail combining with the accompanying drawings so that the advantages and features of the present disclosure can be easily understood by the skilled persons in the art, and thus it is clear to define the protective scope of the present invention.

Figure 1:
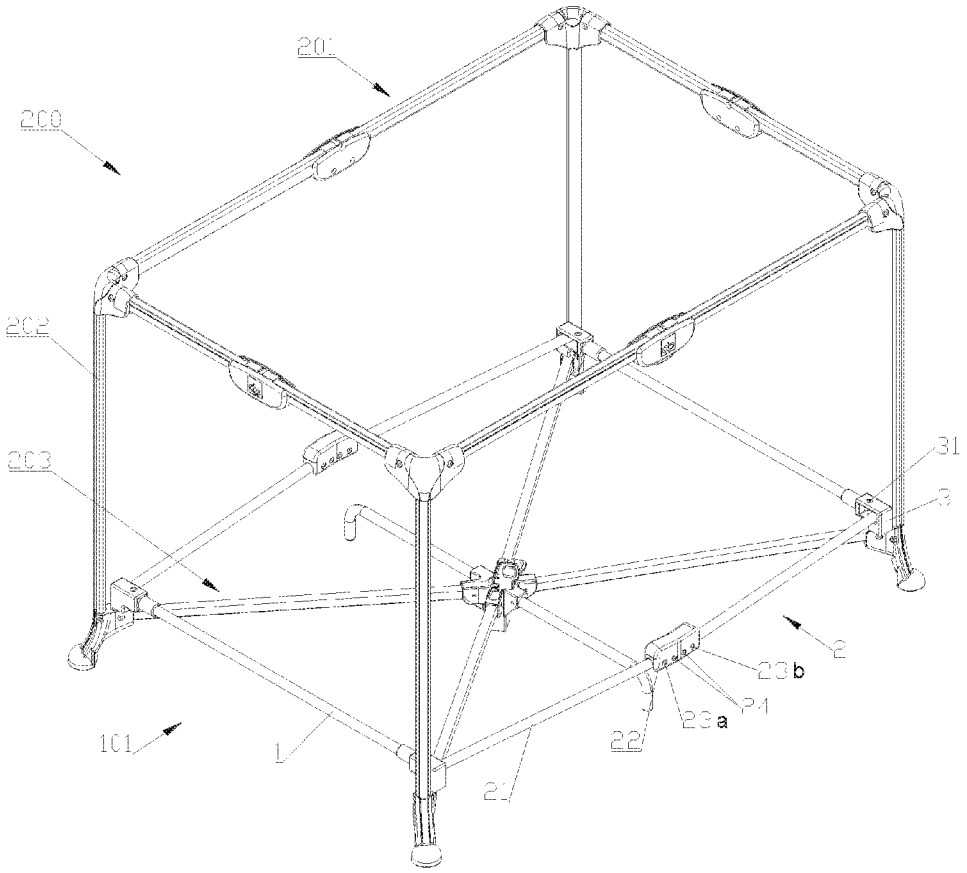
FIG. 1 is a schematic structure diagram of a game enclosure of the present disclosure, wherein the child support assembly is mounted on the enclosure frame and the cloth cover and the cloth bag are omitted.
Figure 2:
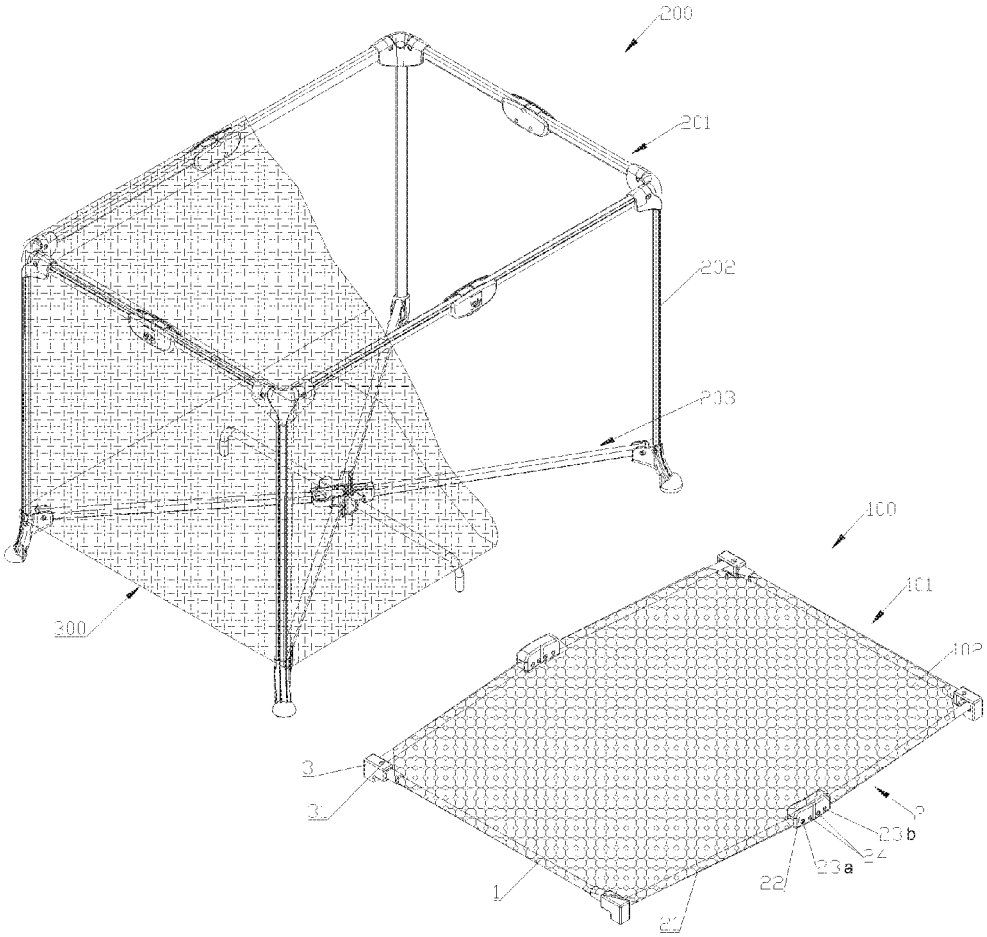
FIG. 2 is a schematic structure diagram of a game enclosure of the present disclosure, wherein the child support assembly is separated from the enclosure frame and only part of the cloth cover is shown.

FIGS. 1 and 2 show a game enclosure. It comprises an enclosure frame 200, a child support assembly 100 and a cloth cover 300 arranged over the enclosure frame 200. The enclosure frame 200 comprises an upper frame 201, a bottom support rack 203 located below the upper frame 201 and a plurality of upright rods 202 arranged between the upper frame 201 and the bottom support rack 203. The child support assembly 100 has a unfolded state and a folded state, when the child support assembly 100 is in the unfolded state, the child support assembly 100 is horizontally and detachably arranged on the upright rods 202 or the bottom support rack 203 or the cloth cover 300, and when it needs to fold the game enclosure or the child support assembly 100 thereof, the child support assembly 100 is detached from the upright rods 202 or the bottom support rack 203 or the cloth cover 300, and achieves the folded state of the child support assembly 100 after be folded for two times.

The child support assembly 100 comprises a cloth bag frame 101, a cloth bag 102 connected on the cloth bag frame 101 to support a child, and a locking mechanism for locking the child support assembly 100 in the unfolded state. The cloth bag frame 101 comprises two cross braces 1 respectively arranged at the front side and the rear side, and two connecting rod assemblies 2 connected between the two cross braces 1 and respectively placed on the left side and the right side, and the orientation terms such as front, rear, left and right mentioned herein are defined as the child support assembly in the unfolded state. When the child support assembly 100 is in the unfolded state, the cross braces 1 and the connecting rod assemblies 2 are connected end-to-end to form a frame. Each connecting rod assembly 2 comprises two connecting rods 21, inner ends of the two connecting rods 21 of each connecting rod assembly 2 are connected in a relatively rotatable manner, and outer ends of the two connecting rods 21 are respectively connected to the two cross braces 1 in a rotatable manner. The two connecting rods 21 of each connecting rod assembly 2 pivot about a pivot extending along a horizontal direction, each of the connecting rods 21 and the cross braces 1 pivot about a pivot extending along a upright direction, and combing with FIGS. 3 and 4, the child support assembly 100 achieves the folded state after two times of folding. In the first folding, the inner ends of the two connecting rods 21 of each connecting rod assembly 2 move upwards or downwards so as to draw the outer ends of the two connecting rods 21 close to each other, that is, the two connecting rods 21 of each connecting rod assembly 2 are drawn close to each other and located at the two sides of the cross braces 1, and in the second folding, the inner ends of the two connecting rods 21 at each side are drawn close to the cross braces 1.

Figure 5:
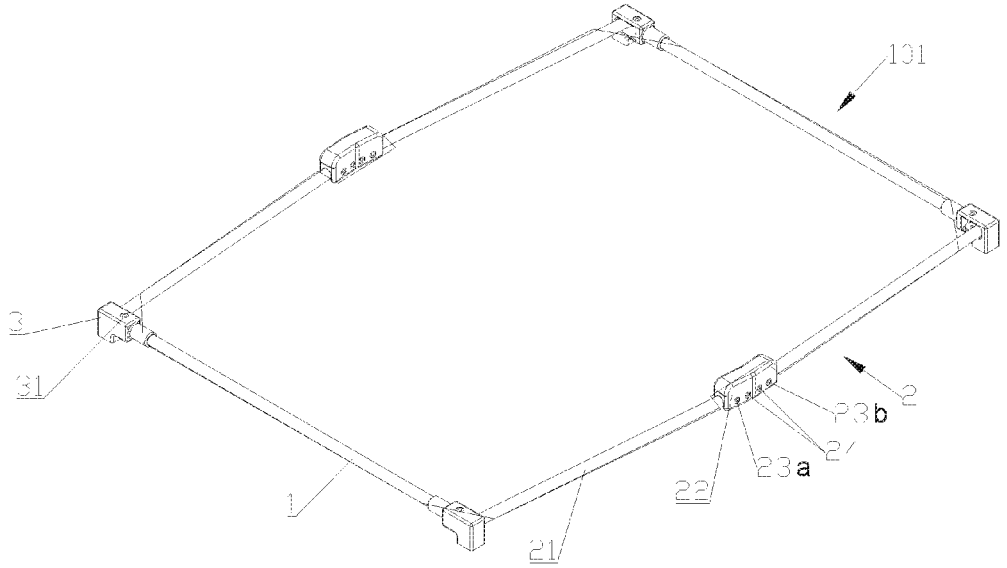
FIG. 5 is a schematic structure diagram of a cloth bag frame of the present disclosure, wherein the two connecting rods of each connecting rod assembly are connected via a first connector.
Figure 6:
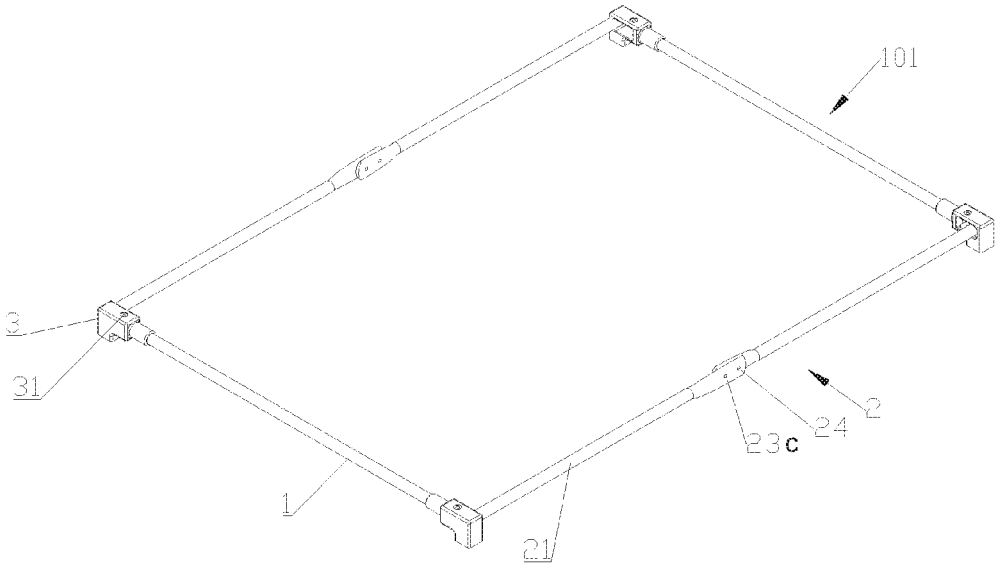
FIG. 6 is a schematic structure diagram of a cloth bag frame of the present disclosure, wherein the two connecting rods of each connecting rod assembly are directly connected.

FIGS. 5 and 6 show the rotatable connecting manner between the two connecting rods 21 of each connecting rod assembly 2 of the present disclosure.

As shown in FIG. 5, each connecting rod assembly 2 comprises a first connector 22, the inner end of one connecting rod 21 in each connecting rod assembly 2 is rotatably connected to the first connector 22 via a first pivot 23*a*, the inner end of the other connecting rod 21 is rotatably connected to the first connector 22 via a second pivot 23*b*. When the child support assembly 100 is in the unfolded state, the first pivot 23*a* and the second pivot 23*b* are parallel to each other and extend along a horizontal direction, in particular, along a left-right direction. The locking mechanism comprises a plurality of locking elements 24 having the same number of the connecting rods, and the locking elements 24 are detachably connected to the connecting rods 21 and the first connectors 22. The locking elements 24 are pins away from the first pivot 23*a* and the second pivot 23*b* for a distance, and the first pivot 23*a* and the second pivot 23*b* are pins. When the locking elements 24 are connected to the connecting rods 21 and the first connectors 22, the locking mechanism locks the child support assembly 100 in the unfolded state, and when the locking elements 24 are detached from the two connecting rods 21 and the first connectors 22, the child support assembly 100 is in a foldable unlocked state.

As shown in FIG. 6, the inner ends of the two connecting rods in each connecting rod assembly 2 are directly connected in a relatively rotatable manner via a third pivot 23*c* (such as a pin), and the two connecting rods 21 of each connecting rod assembly are detachably connected via a locking element 24, and the locking element 24 is a pin arranged away from the third pivot 23*c* for a distance. When the locking element 24 is connected to the two connecting rods 21, the locking mechanism locks the child support assembly 100 in the unfolded state, and when the locking element 24 is detached from the two connecting rods 2, the child support assembly 100 is in a foldable unlocked state.

Two end portions of the cross brace 1 are fixedly connected with second connectors 3 respectively, and the outer end of the connecting rod 21 is rotatably connected to the second connector 3 via a fourth pivot 31. When the child support assembly 100 is in the unfolded state, the fourth pivot 31 extends along a upright direction.

Figure 3:
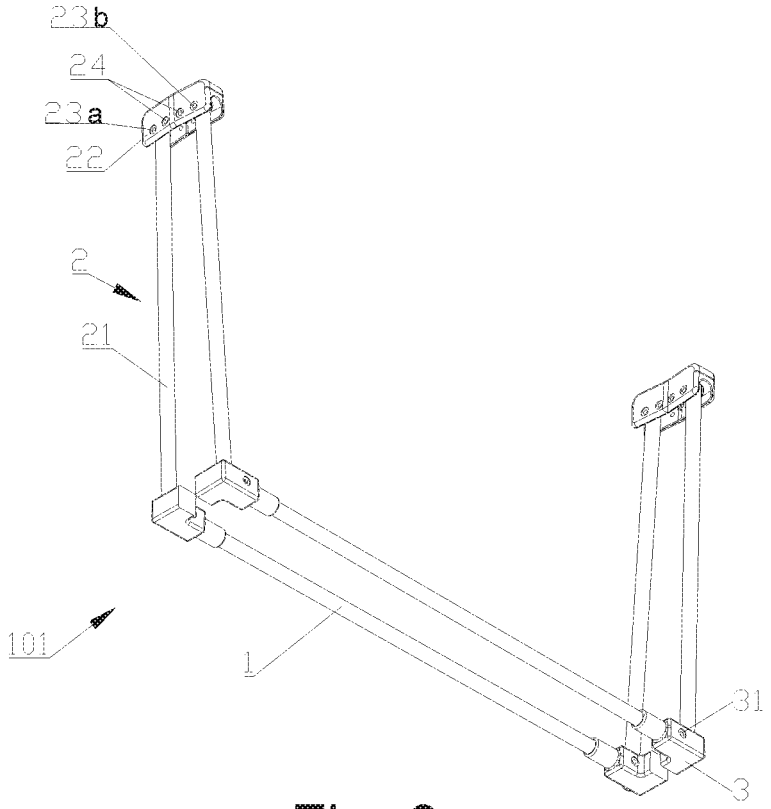
FIG. 3 is a schematic structure diagram of a cloth bag frame of the present disclosure in the first folding.
Figure 4:
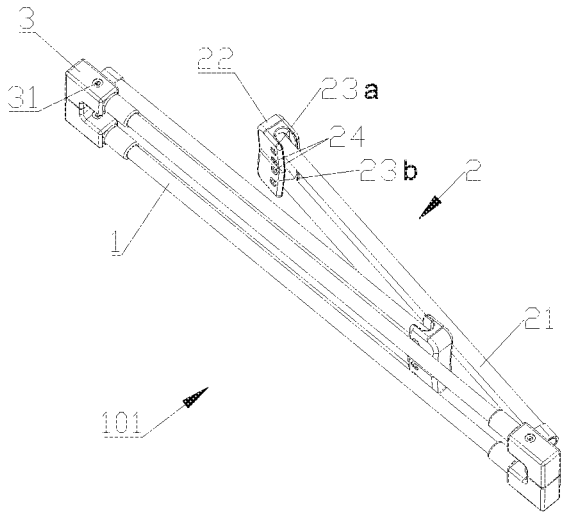
FIG. 4 is a schematic structure diagram of a cloth bag frame of the present disclosure in the second folding.

As shown in FIG. 3, during folding the child support assembly 100, the specific process of the first folding is as follow: detaching the two locking elements 24 of each connecting rod assembly 2, unlocking the two connecting rods 21 of each connecting rod assembly 2, drawing the first connectors 22 or inner ends of the connecting rods 21 upwards, drawing the two connecting rods 21 of each connecting rod assembly 2 close to each other so as to draw the two cross braces 1 close therewith. As shown in FIG. 4, the specific process of the second folding is as follow: rotating each connecting rod 21 by taking the fourth pivot 31 as a pivot point so as to draw the connecting rods 21 of both two connecting rod assemblies 2 close to the cross braces 1; the volume of the folded child support assembly 100 is very small, and the cloth bag 102 is folded along with the folding of the cloth bag frame 101, which is convenient to get folded.

As shown in FIGS. 1 and 2, when the child support assembly 100 is in the unfolded state, due to that the connecting rods 21 and the cross braces 1 are connected in a relatively rotatable manner via the fourth pivot 31 extending along the upright direction, each connecting rod assembly 2 is locked via two locking elements 24 of the locking mechanism, that is, the entire child support assembly 100 is unfolded stably.

The cloth bag 102 is made of gauze providing malleability, which significantly improves the gas permeability and the flexibility of the child support assembly 100 due to that the gauze has excellent gas permeability and malleability, and the cloth bag 102 gets folded along with the folding of the cloth bag frame 101. As shown in FIG. 2, the connecting rod 21 is inclined from the outer end to the inner end thereof so as to be gradually remote from another connecting rod assembly 2. When the cloth bag 102 is connected to the cloth bag frame 101, each the connecting rod assembly 2 is slightly deformed to tighten the cloth bag 102 over the cloth bag frame 101. Comparing with the child support assembly 100 made of fiberboards and the like in the prior art, the cloth bag 102 has excellent gas permeability and malleability, which significantly improves the gas permeability and the flexibility of the child support assembly 100; and due to that the cloth bag 102 made of gauze has certain malleability, the cloth bag 102 gets folded along with the folding of the cloth bag frame 101, and the child support assembly 100 is easy to be folded and has a small folded volume.

When the child support assembly 100 is arranged on the upper part of the enclosure frame 200 or the upper part of the cloth cover 300, the game enclosure and the child support assembly of the present disclosure may also be used as a child's bed and the body of a child's bed.

The horizontal direction, the upright direction, left, right, front, rear mentioned in the disclosure are all defined by the specific orientation in which the child support assembly is in the unfolded state and in use by the user.

The embodiments described above are only for illustrating the technical concepts and features of the present application, are preferred embodiments, and are intended to make those skilled in the art being able to understand the present application and thereby implement it, and should not be concluded to limit the protective scope of this invention. Any equivalent variations or modifications according to the spirit of the present application should be covered by the protective scope of the present application.

The invention claimed is:

1. A game enclosure comprising an enclosure frame, a child support assembly and a cloth cover arranged over the enclosure frame, the enclosure frame comprises an upper frame, a bottom support rack located below the upper frame and a plurality of upright rods arranged between the upper frame and the bottom support rack, wherein, the child support assembly has a unfolded state and a folded state, when the child support assembly is in the unfolded state, the child support assembly is horizontally and detachably arranged on the upright rods or the bottom support rack or the cloth cover, and when the child support assembly is in the folded state, the child support assembly is detached from the upright rods or the bottom support rack or the cloth cover; the child support assembly comprises a cloth bag frame and a cloth bag connected on the cloth bag frame to support a child, the cloth bag frame comprises two cross braces respectively arranged at a front side and a rear side of the enclosure frame, and two connecting rod assemblies connected between the two cross braces and respectively placed on a left side and a right side of the enclosure frame, each connecting rod assembly comprises two connecting rods, inner ends of the two connecting rods of each connecting rod assembly are connected in a relatively rotatable manner, and outer ends of the two connecting rods are respectively connected to the two cross braces in a rotatable manner; when the child support assembly is in the folded state, the outer ends of the two connecting rods on the same side are drawn close to each other, and the inner ends of the respective connecting rods are drawn close to the cross braces.

2. The game enclosure according to claim 1, wherein, each connecting rod assembly comprises a first connector, the inner end of one connecting rod in each connecting rod assembly is rotatably connected to the first connector via a first pivot, the inner end of the other connecting rod is rotatably connected to the first connector via a second pivot, and when the child support assembly is in the unfolded state, the first pivot and the second pivot are parallel to each other and extend along a horizontal direction.

3. The game enclosure according to claim 1, wherein, the inner ends of the two connecting rods in each connecting rod assembly are connected in a relatively rotatable manner via a pivot, and when the child support assembly is in the unfolded state, the pivot extends along a horizontal direction.

4. The game enclosure according to claim 1, wherein, the child support assembly comprises a locking mechanism for locking the child support assembly in the unfolded state or in the folded state.

5. The game enclosure according to claim 4, wherein, the locking mechanism comprises a plurality of locking elements, a number of the plurality of locking elements being the same as a number of the connecting rods, each connecting rod assembly comprises a first connector, the inner end of one connecting rod in each connecting rod assembly is rotatably connected to the first connector via a first pivot, the inner end of the other connecting rod is rotatably connected to the first connector via a second pivot, and when the child support assembly is in the unfolded state, the first pivot and the second pivot are parallel to each other and extend along a horizontal direction; the locking elements are detachably connected to the connecting rods and the first connectors, when the locking elements are connected to the connecting rods and the first connectors, the locking mechanism locks the child support assembly in the unfolded state, and when the locking elements are detached from the connecting rods and the first connectors, the child support assembly is in a foldable unlocked state.

6. The game enclosure according to claim 4, wherein, the locking mechanism comprises locking elements detachably connected to the two connecting rods of each connecting rod assembly, the inner ends of the two connecting rods in each connecting rod assembly are connected in a relatively rotatable manner via a pivot, and when the child support assembly is in the unfolded state, the pivot extends along a horizontal direction; when the locking elements are connected to the two connecting rods of each connecting rod assembly, the locking mechanism locks the child support assembly in the unfolded state, and when the locking elements are detached from the two connecting rods of each connecting rod assembly, the child support assembly is in a foldable unlocked state.

7. The game enclosure according to claim 1, wherein, the cloth bag frame further comprise a plurality of second connectors, one of the cross brace and the connecting rod is fixedly connected to the second connector and the other one is rotatably connected to the second connector via a pivot, and the pivot extends along a upright direction.

8. The game enclosure according to claim 1, wherein, when the child support assembly is in the unfolded state, each of the connecting rods is inclined from the outer end to the inner end thereof so as to be gradually remote from another connecting rod assembly, and each of the connecting rod assemblies is slightly deformed to tighten the cloth bag over the cloth bag frame.

9. The game enclosure according to claim 1, wherein, the two connecting rods of each connecting rod assembly pivot about a pivot extending along a horizontal direction, each of the connecting rods and the cross braces pivot about a pivot extending along a upright direction, and the child support assembly achieves the folded state after twice folding, in a first folding, the inner ends of the two connecting rods of each connecting rod assembly move upwards or downwards so as to draw the outer ends of the two connecting rods close to each other, and in a second folding, the inner end of each connecting rod is drawn close to the cross brace.

10. The game enclosure according to claim 1, wherein, the cloth bag is made of gauze providing malleability.

* * * * *